US007878426B2

(12) United States Patent
Denzler

(10) Patent No.: US 7,878,426 B2
(45) Date of Patent: Feb. 1, 2011

(54) SANITARY OUTLET UNIT

(75) Inventor: Oliver Denzler, Bottmingen (CH)

(73) Assignee: Neoperl GmbH, Mullheim (DE)

( * ) Notice: Subject to any disclaimer, the term of this patent is extended or adjusted under 35 U.S.C. 154(b) by 435 days.

(21) Appl. No.: 11/722,043

(22) PCT Filed: Jan. 19, 2006

(86) PCT No.: PCT/EP2006/000443

§ 371 (c)(1),
(2), (4) Date: Jun. 18, 2007

(87) PCT Pub. No.: WO2006/077109

PCT Pub. Date: Jul. 27, 2006

(65) Prior Publication Data

US 2008/0272212 A1 Nov. 6, 2008

(30) Foreign Application Priority Data

Jan. 24, 2005 (DE) ..... 10 2005 003 404

(51) Int. Cl.

| | |
|---|---|
| ***A62C 5/00*** | (2006.01) |
| ***F23D 11/16*** | (2006.01) |
| ***E03C 1/08*** | (2006.01) |
| ***B05B 7/12*** | (2006.01) |
| ***B05B 7/06*** | (2006.01) |
| ***B05B 1/30*** | (2006.01) |

(52) U.S. Cl. ..... 239/428.5; 239/398; 239/407; 239/419.5; 239/432; 239/575

(58) Field of Classification Search ..... 239/398, 239/407, 413, 419.5, 428.5, 432, 575
See application file for complete search history.

(56) References Cited

U.S. PATENT DOCUMENTS

| | | | | |
|---|---|---|---|---|
| 2,510,396 | A * | 6/1950 | Goodrie | 239/428.5 |
| 3,799,450 | A * | 3/1974 | Braukman | 239/428.5 |
| 4,072,270 | A * | 2/1978 | Harmony | 239/428.5 |
| 4,591,098 | A * | 5/1986 | Ridenour | 239/288.3 |
| 5,743,291 | A | 4/1998 | Nehm et al. | |
| 6,322,004 | B1 * | 11/2001 | Perdreau et al. | 239/428.5 |
| 6,708,902 | B2 * | 3/2004 | Takeshi et al. | 239/428.5 |
| 2005/0156062 | A1 * | 7/2005 | Thomas et al. | 239/548 |

FOREIGN PATENT DOCUMENTS

| | | |
|---|---|---|
| DE | 1209515 | 1/1966 |
| DE | 1220345 | 6/1966 |

(Continued)

*Primary Examiner*—Len Tran
*Assistant Examiner*—Ryan Reis
(74) *Attorney, Agent, or Firm*—Volpe and Koenig, P.C.

(57) ABSTRACT

A sanitary outlet unit (1) is provided, including an outlet armature (2), with a flow regulator (4) in a region of the water outlet (3) thereof, wherein an aeration device is provided for aeration of the water flow. The outlet unit (1) provides that the aeration unit (5) is located in the outlet armature (2) and/or in at least one water line leading to the outlet armature (2) separately from the flow regulator (4). Through the spatial separation of the functions of flow shaping or water discharge and the aeration of the water flow, there are many possible embodiments for optionally providing the water outlet (3) of the sanitary outlet unit (1) with an extremely thin design.

23 Claims, 10 Drawing Sheets

FOREIGN PATENT DOCUMENTS

| | | |
|---|---|---|
| DE | 1609044 | 11/1971 |
| DE | 3000799 | 7/1981 |
| DE | 3825537 | 2/1989 |
| DE | 29615925 | 12/1996 |
| DE | 19901704 | 8/2000 |
| GB | 1219925 | 3/1971 |

* cited by examiner

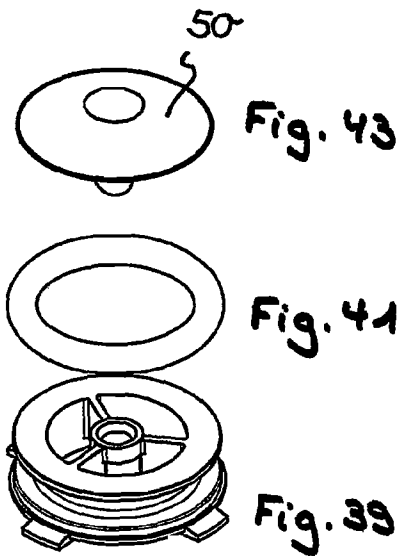
Fig. 43
Fig. 41
Fig. 39
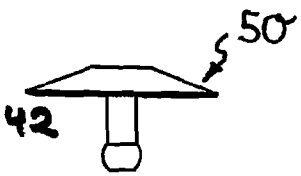
Fig. 42
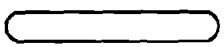
Fig. 40
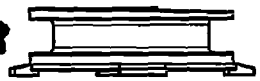
Fig. 38
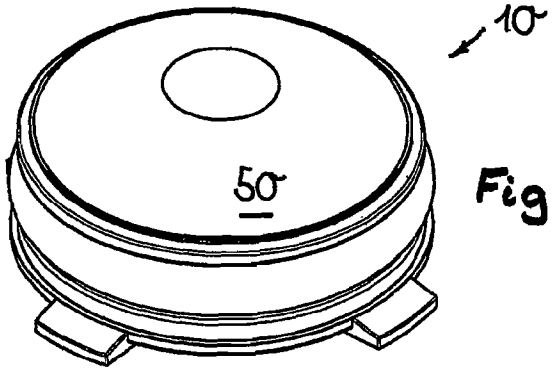
Fig. 37
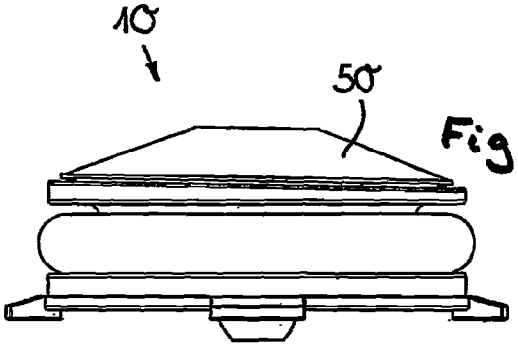
Fig. 35
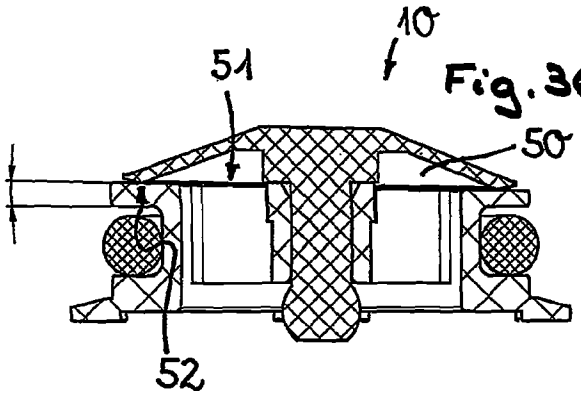
Fig. 36

SANITARY OUTLET UNIT

BACKGROUND

The invention relates to a sanitary outlet unit with an outlet armature, having a water outlet, with an aeration device being provided for aerating the water flow.

Various flow regulators are known, which aerate a water flow exiting a sanitary outlet armature in order to form a homogenous, bubbling-soft water flow. For this purpose, the known flow regulators are provided in their flow regulator housing with a flow splitter, usually embodied as a perforated plate, with a homogenization unit and perhaps a flow straightener being arranged downstream. The flow regulator housing of the known flow regulators is provided with aerating openings in the area of the homogenization device, which serve as an aeration device for aerating the water flow, temporarily separated into individual jets via the flow splitter (cf. DE-A-30 00 799). The known flow regulator with their flow regulator housings are inserted into an outlet mouthpiece, which can be fastened at the fitting outlet via a screw connection.

The outlet mouthpiece necessary for fastening the known flow regulators determines the shape of the sanitary outlet armatures in the proximity of the fitting outlet. However, it is increasingly attempted to design unconventional and esthetically demanding sanitary outlet armatures.

SUMMARY

Therefore the object of the invention is to provide a sanitary outlet unit of the type mentioned at the outset which in the embodiment of its outlet armatures offers the greatest-possible design freedom with at least the same functionality.

The object is attained according to the invention in the sanitary outlet unit of the type mentioned at the outlet, in particular, in that the aeration device is provided in the flow direction at a distance upstream in reference to the water outlet inside the outlet armature and/or at least in one of the water pipes leading to the outlet armature.

In the outlet unit according to the invention the aeration device is arranged upstream in the flow direction at a distance from the water outlet. Here, a spatial separation is achieved between the water outlet of the outlet armature, on the one hand, and the aeration device, on the other hand. This way, for example, in the water outlet of the outlet armature a jet formation can occur, while the air inlet and, if applicable, the determination of the amount of flow is performed at a location arranged further upstream. By this spatial separation the water outlet itself can be designed extremely slender so that design freedom as great as possible in the design of such outlet units is achieved without any loss in functionality.

Here, a particularly beneficial embodiment according to the invention provides that the outlet armature has a flow regulator in the area of its water outlet, and that the aeration device is provided separated from the flow regulator in the outlet armature and/or at least in one of the water lines leading to the outlet armature. In this preferred embodiment, a spatial separation occurs between the aeration of the water flow, on the one hand, and the jet formation provided in the flow regulator, on the other hand. The jet formation occurs at the water outlet of the outlet armature, while the air inlet is provided at a distance in the flow direction upstream in reference to the water outlet.

Due to the fact that the water outlets of the prior art outlet armatures are frequently arranged at the highest point of an outlet armature it must be ensured that when the outlet armature is closed the water still remaining in the outlet armature does not exit through the aeration device arranged lower than the water outlet. It is therefore beneficial when the aeration device has at least one one-way aeration valve or a reflux prevention device.

Here, a preferred embodiment according to the invention provides for the aeration device to include at least one duckbill or membrane valve and/or at least one umbrella valve.

In order to optionally get an aerated or non-aerated water jet from the outlet unit according to the invention it is beneficial to allow the aeration device to be opened or closed.

Here, a particularly simple embodiment of the invention, associated with only small production expense, provides that the aeration opening of the aeration device has a closing lid upstream the aeration device, which releases the aeration opening in an opened position and closes the aeration opening in a closed position in a sealing manner.

In order to allow the water jet flowing through the aeration device to suction and entrain air and mixing therewith it is beneficial when immediately upstream of the mouth forming the mixing zone of air and water inlet, an acceleration path is interposed in the water inlet for accelerating the water to be mixed with air.

Here, a preferred embodiment according to the invention provides for the acceleration path to be provided as a construction in the cross-section of the water pipe upstream in reference to the aeration device.

A better mixing of the water jet with air is achieved when a water guide is provided downstream in reference to the aeration device, guiding the aerated water jet at the interior perimeter of the water pipe or the outlet armature. In this particularly advantageous embodiment, the water jet exiting the aeration device is intentionally directed to the walls of the fitting housing, in order to be reflected there and thus better interlaced.

Here, a particularly simple embodiment according to the invention, associated with little production expense, provides that the water guidance is embodied as a V-shaped or funnel shaped guidance grid, tapering in the flow direction, with its guide walls surrounding the grid openings being embodied as water guidance walls.

The grid openings of the guide grid have a large cross-section for the flow and yet through the guide walls surrounding the grid openings provide good guidance of the water jet when the grid openings of the guidance grid are essentially embodied honeycomb-shaped.

It is beneficial for the aeration device to be embodied as inserted cartridges or integrated cartridges, which can be inserted into pipe or fitting sections leading to the water outlet.

A particularly preferred embodiment according to the invention provides for the cartridge housing of the aeration device to be provided upstream with at least one penetration opening and that at least one penetration opening is embodied as an acceleration path.

Here, it is advantageous when the water guide is provided in the area of the housing outlet of the casing housing.

The aeration device can be inserted particularly well into the fitting housing if the valve outlet of at least one aeration valve is provided in the area between the acceleration path and the housing outlet of the casing housing.

Here, a preferred embodiment according to the invention provides that the fitting housing is provided at a distance upstream in reference to the water outlet with an insertion opening leading to the clear cross-section of the fitting, in which the aeration device can be preferably inserted in a detachable manner.

An aeration device embodied as an inserted casing or an integrated cartridge can be immediately inserted into a cast housing, particularly embodied as a cast body, when the receptacle for this inserted casing or integrated cartridge is produced in a respective cutting manner in the fitting housing. An advantageous embodiment according to the invention provides therefore that the insert opening opens into a preferably sheath-shaped cartridge or casing receptacle, which is used for receiving the aeration device embodied as inserted casing or integrated cartridge. This sheath-shaped cartridge or casing receptacle can for example be produced from a thin-walled sheet metal construction, which is mounted in the fitting housing of the outlet armature.

It is possible to provide the aeration device immediately in the fitting housing of the outlet armature. Additionally or instead thereof the aeration device may also be arranged in a pipe adapter, which can be interposed in at least one water line leading to an outlet armature.

The aeration device can also be mounted, hardly visible, outside the sink when the aeration device is arranged in a pipe adapter, which can be interposed in at least one of the water lines leading to an outlet armature.

Here, it is a particular advantage of an aeration device arranged in a line adapter that the aeration device can be interposed in the warm water or the cold water line. When the aeration device is interposed in the warm water or the cold water line, based on the jet image it is easily discernible if the water flowing out of the outlet armature represents warm and/or cold water. When for example an air-water mixture is provided in the warm water line, while the cold water inlet is not provided with an aeration device, this means that a crystal clear water jet represents cold water, while a strongly aerated water jet indicates hot water and a slightly aerated water jet mixed water. The user can therefore recognize the approximate temperature condition of the water flowing out of the outlet armature, based on the level of air mixed in, for example the opacity and white coloration by the water bubbles.

In order to create an aerated and accordingly bubbling-soft water jet it may be beneficial to embody the outlet armature as a shower device.

Another preferred exemplary embodiment provides that the outlet armature is embodied as a hand-held or kitchen sprayer. Normally, such kitchen sprayers provide the option to switch the water jet from spray jet to normal jet. By integrating an aeration device, which may perhaps can be closed, for example in the sprayer handle of such a hand-held or kitchen sprayer, it is possible for the user to design the spray jet or the normal jet optionally with or without any air mixed therein so that the possibility of jet variations can be doubled in such an aeration device, which offers the user an additional benefit.

BRIEF DESCRIPTION OF THE DRAWINGS

In the following, the invention with its essential features is explained in greater detail using the drawings. Shown are.

DETAILED DESCRIPTION OF THE PREFERRED EMBODIMENTS

Figures 1, 2, 3, 4, 5, 6, 7:
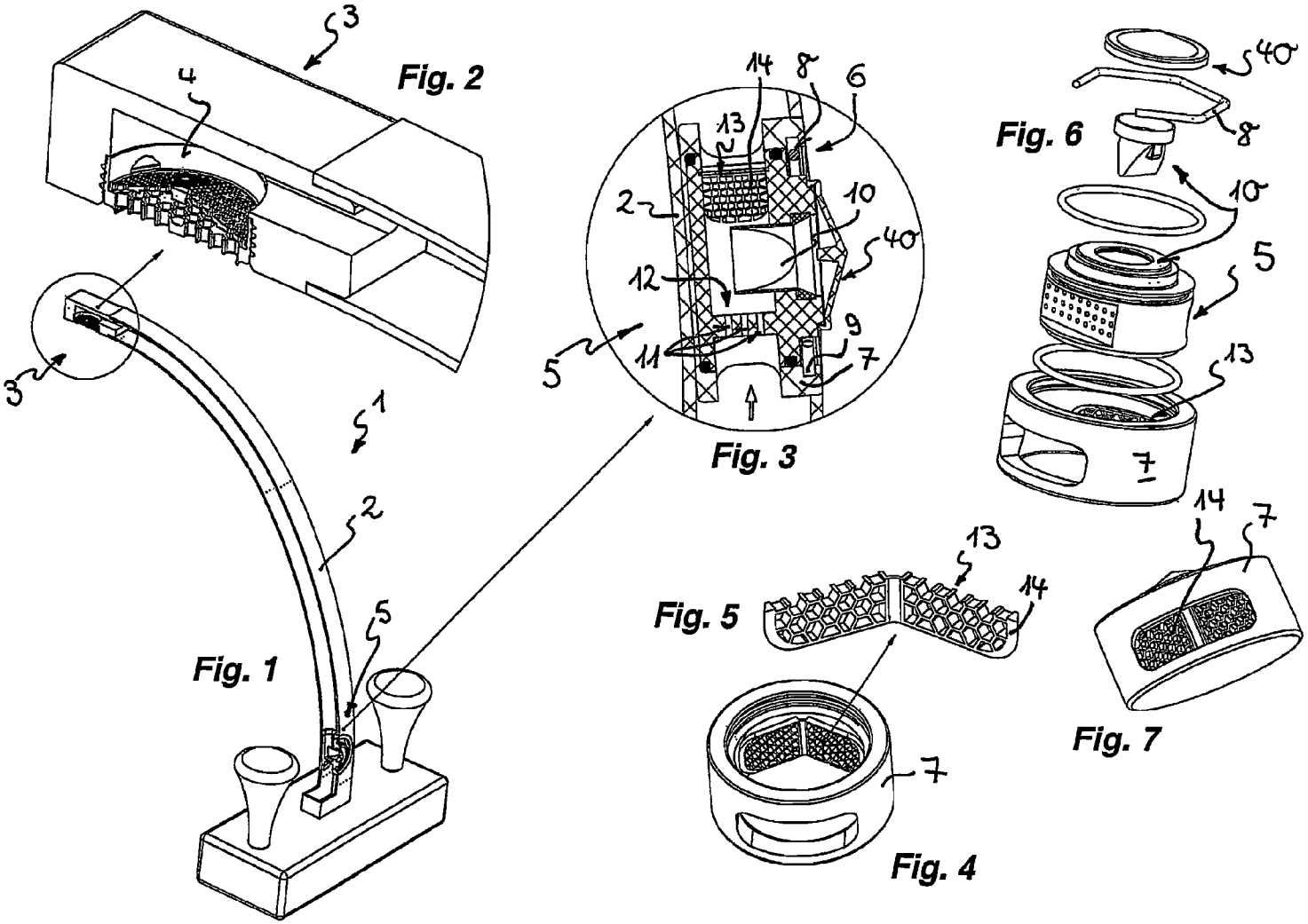
FIG. 1 a perspective view of a sanitary outlet unit having at its water outlet a flow regulator and upstream, in the fitting housing, an aeration device for aerating the water flowing through the outlet armature, FIG. 2 a view of the outlet unit of FIG. 1 in the area of the water outlet of its outlet armature, FIG. 3 a view of the outlet unit of FIGS. 1 and 2 in the area of the aeration device located in the fitting housing of the outlet armature, FIG. 4 a perspective view of the aeration device of the outlet unit according to FIGS. 1 through 3, embodied as an inserted casing or an integrated cartridge, FIG. 5 a view of a water guide provided downstream at the aeration device and embodied as a guidance grid, FIG. 6 an exploded view showing individual parts of the aeration device of the outlet unit from FIGS. 1 through 5, FIG. 7 a perspective side view of the aeration device of the outlet unit shown in FIGS. 1 through 6, FIG. 8 a view of a comparable aeration device not provided with any water guide downstream, FIG. 9 a perspective side view of the aeration device of FIG. 7, FIG. 10 a longitudinal cross-sectional view of an aeration device mounted in a fitting unit housing, with the aeration device having a one-way aeration valve embodied as an umbrella valve, FIG. 11 an exploded view showing individual parts of the aeration device of FIG. 10, FIG. 12 a perspective side view of the aeration device of FIGS. 10 and 11, FIG. 13 a view of a sanitary outlet unit, comparable to FIG. 1, with its aeration device being able to be opened or closed via a closing lid, FIG. 14 a view of an outlet unit of FIG. 13 in a lateral cross-section in the area of the water outlet, FIG. 15 a longitudinal cross-sectional view of an outlet unit of FIGS. 13 and 14 in the area of the aeration device, FIG. 16 a perspective side view of the aeration device allocated to the outlet unit according to FIGS. 13 through 15, FIG. 17 an exploded view showing individual parts of the aeration device of FIG. 16, FIG. 18 a longitudinal cross-sectional view of an aeration device which without any receptacle sheath, can directly be inserted into a receptacle of the outlet armature cast body, produced in a cutting manner, FIG. 19 an exploded view of an aeration device of FIG. 18, FIG. 20 a view of an outlet unit embodied as a shower, with an aeration device located in a pipe adaptor being integrated upstream thereof.

In FIGS. 1 through 7, a sanitary outlet unit 1 is shown in various views. The outlet unit 1 is provided with an outlet armature 2, which in the area of its water outlet 3 has a flow regulator 4 shown in FIG. 2, which shall homogenously form the exiting water jet. In order to allow the water jet to be aerated and to create a pearly-soft water jet an aeration device 5 is provided.

In a comparison of FIGS. 1 through 3 it is discernible that the aeration device 5 is provided separate from the flow regulator 4 in the outlet armature 2. For this purpose, in the armature housing of the outlet armature 2, an insert opening 6 is provided upstream, at a distance from the water outlet 3 and the flow regulator 4 located there, laterally at the fitting housing, leading to the open cross-section of the fitting. This insert opening 6 leads to a sheath-shaped casing or cartridge receptacle 7, arranged in the armature housing, which is embodied as a thin-walled sheet metal construction and open both towards upstream as well as downstream.

The aeration device 5, embodied as an insertion casing or integrated cartridge, can be inserted in a detachable manner into the sheath-shaped cartridge or casing receptacle 7 via the insert opening 6 and is here held by a snap ring 8, which can be inserted into a groove 9 at the side of the opening in the cartridge receptacle 7.

In the outlet unit 1 shown here, the jet formation caused by the flow regulator 4 remain at the water outlet 3 of the sanitary fitting 2, while the air inlet and the determination of the flow amount is moved to a point further upstream. Due to the fact that the water outlet 3 occurs at the highest point of the outlet armature 2 the aeration device 5 has a one-way aeration valve 10, which here is embodied as a duck-bill or membrane valve which prevents an exiting of water remaining in the outlet armature 2 through an aeration opening arranged below the water outlet 3. The one-way aeration valve 10 is covered from sight by a front-mounted grid 40, which also serves as a vision block.

In FIGS. 3 and 6 it is discernible that the casing housing of the aeration device 5 has several penetrating openings 11 upstream embodied as cross-sectional constrictions, which form an acceleration path 12 for accelerating the water flow to be mixed with air. Downstream from the aeration device 5 there is a water guide 13, leading the aerated water flow to the interior perimeter of the water pipe and particularly the outlet unit 2, with the guide being embodied as a V-shaped or funnel shaped guiding grid 14 tapering in the direction of flow, with its guide walls which surround the grid openings being embodied as water guide walls. In order to maintain a flow cross-section as large as possible, and simultaneously to allow as good as possible the water flow to be guided along the guide walls surrounding the grid openings, the grid openings of the guiding grid 14 are embodied essentially in the form of honey-combs. The guidance grid 14 serving as a water guide is provided in the area of the housing outlet of the casing housing and held downstream in the cartridge receptacle 7.

The valve outlet of the aeration valve 10 is arranged in the area between the acceleration path 2 and the housing outlet of the casing housing. The valve outlet of the aeration valve 10 opens into a mixing zone, which is arranged in the mouth of the air and water inlet. The water flow accelerated in the acceleration path 12 can suction, sufficiently mix, and entrain the air entering the mixing zone through the aeration valve 10.

The spatial separation of the function water outlet and water forming, on the one hand, and the air intake in the aeration device 5, on the other hand, allows the design of the water outlet 3 of the outlet armature 2 in an extremely slender manner.

Figure 8:
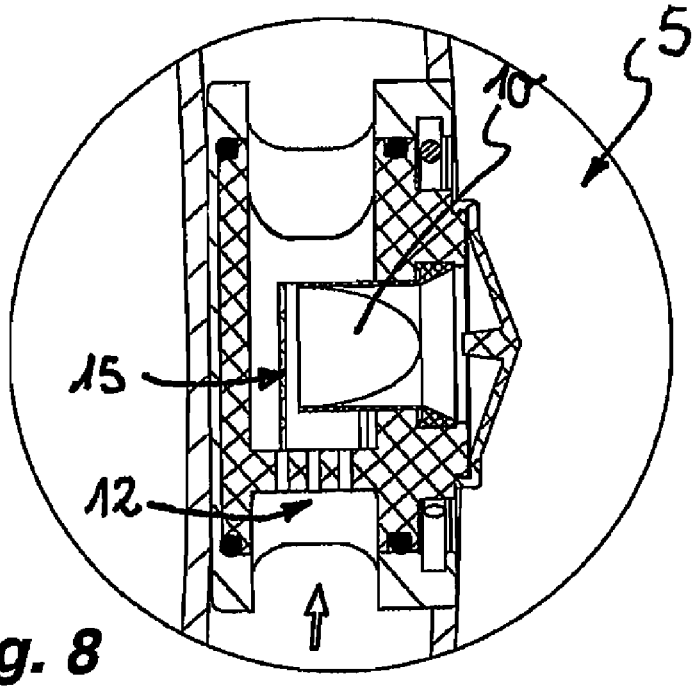
Figure 9:
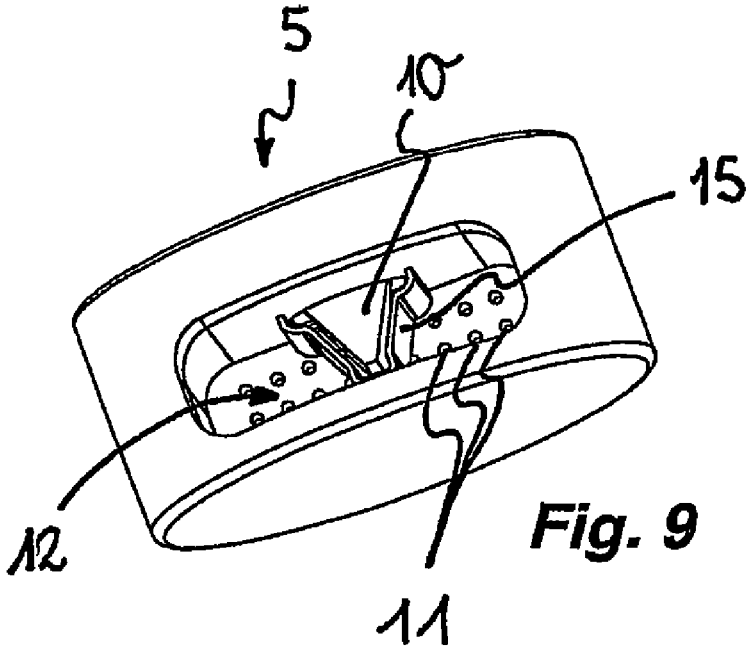

FIGS. 8 and 9 show an aeration device 5, for which an outlet unit is determined similar to FIGS. 1 through 7. The V-shaped guiding grid 14 provided, which serves to improve interlacing of the flow, is not included, here to simplify the illustration. The aeration device 5 shown in FIGS. 8 and 9 has a protective basket or jacket 15 open towards downstream, which surrounds the aeration valve 10 in its section protruding into the mixing zone. The protective basket 15 prevents fast, bundled water jets exiting the acceleration lane 12 with high speed from directly impinging the aeration valve 10 and which can lead to malfunctions.

Figure 10:
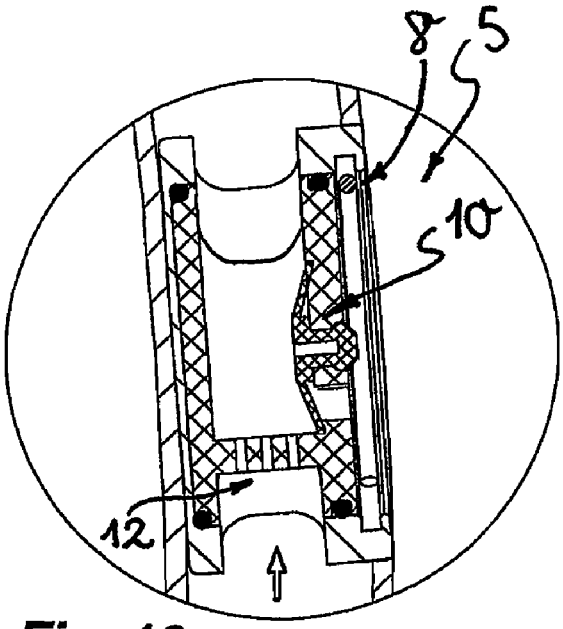
Figure 11:
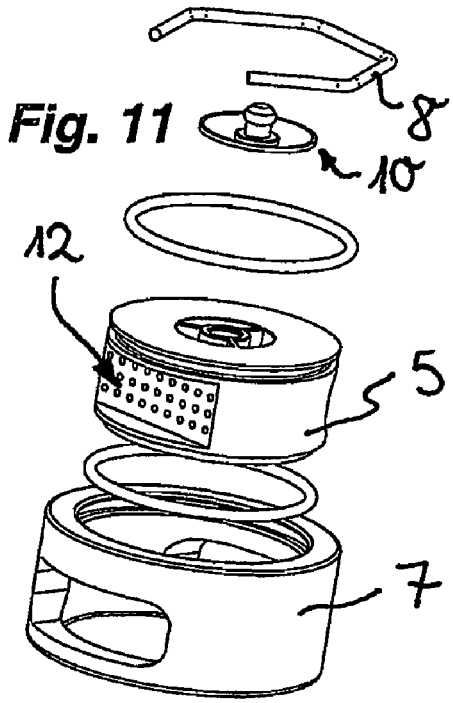
Figure 12:
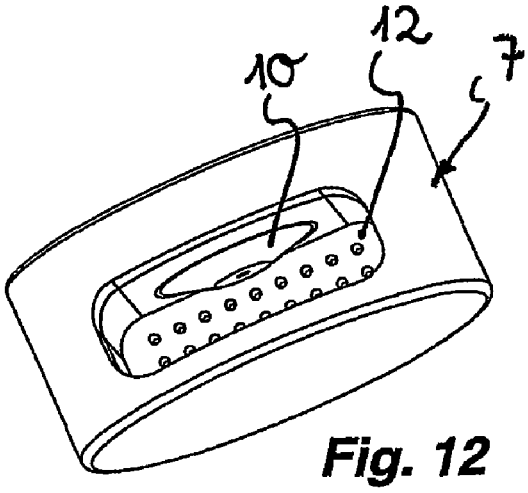
Figure 17:
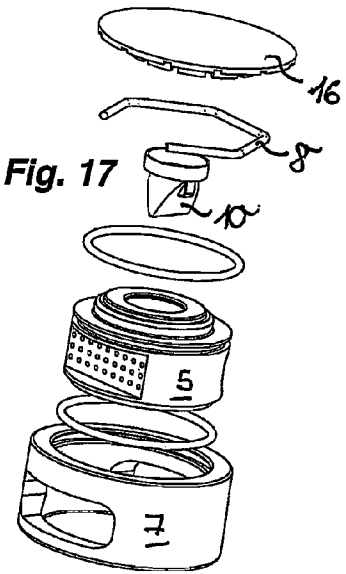
Figure 15:
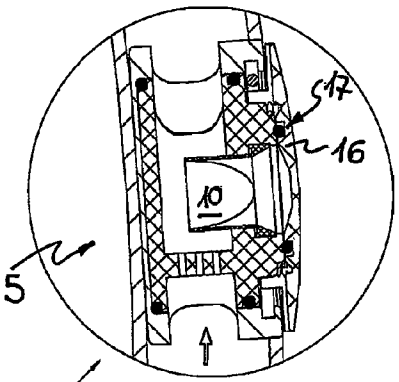
Figure 16:
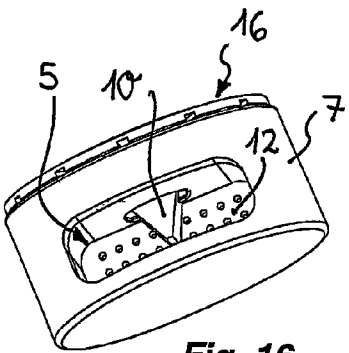
Figure 14:
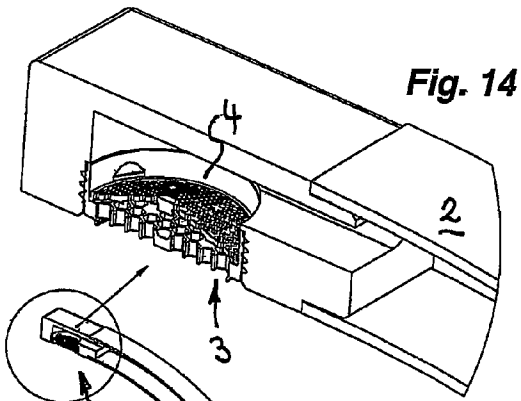
Figure 13:
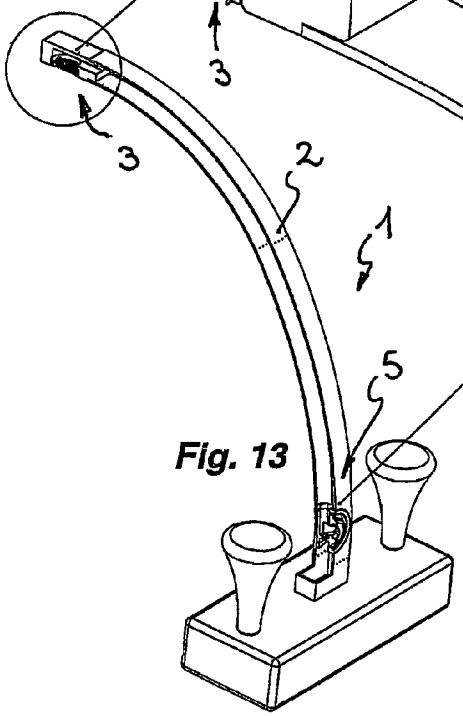

In FIGS. 10 through 12, an aeration device 5 similar to FIGS. 8 and 9 is shown, with its aeration valve 10 here being embodied as an umbrella valve. Compared to the membrane valve shown in FIGS. 1 through 8, the umbrella valve 10 in FIGS. 8 and 9 is comparatively flat and has a considerably lower structural height.

In FIGS. 13 through 17, a sanitary outlet unit 1 with an aeration device 5 is shown, which can be opened and closed. For this purpose, a closing lid 16 is mounted upstream of the aeration opening of this aeration device 5, which releases the aeration opening in an open position and closes in a closed position the aeration opening in a sealing fashion.

By rotating the closing lid 16 the air intake can be closed so that the user is free to choose if he/she wants a water output in an aerated form or in an non-aerated form. By rotating the closing lid 16, the O-ring 17 located in the closing lid 16 is loosened from its position, so that an air intake is possible into the water flow through the aeration valve 10. When the closing lid 16 is rotated, which for example is connected via a thread to the casing or cartridge housing of the aeration device 5, until the O-ring 17 of the closing lid 16 at the face that contacts the aeration valve 10 or the aerating device 5, the air intake via the aeration valve 10 is interrupted, so that the water flowing through the sanitary outlet unit 1 is no longer aerated.

Figure 18:
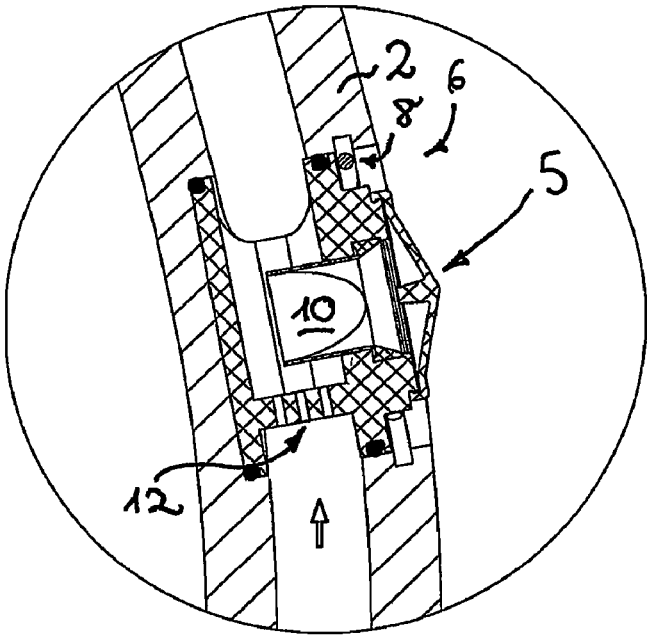
Figure 19:
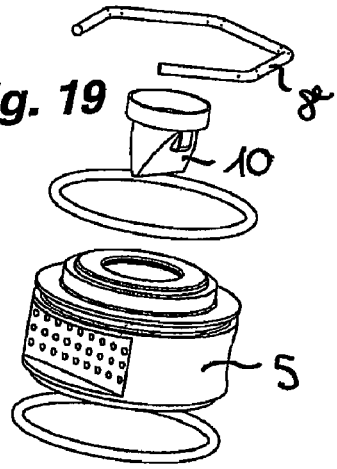

In FIGS. 18 and 19 an aeration device 5 is shown, which can be inserted directly into the cast body of the outlet armature through an insertion opening 6. Contrary to the aeration devices 5 shown in FIGS. 1 through 17 the aeration device according to FIGS. 18 and 19 can omit a sheath-shaped cartridge or casing receptacle, because the receptacle for the aeration device 5 according to FIGS. 18 and 19 is integrated through cutting directly into the outlet unit 2 at the cast body.

Figure 22:
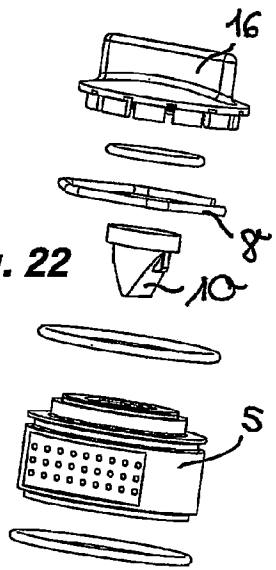
Figure 21:
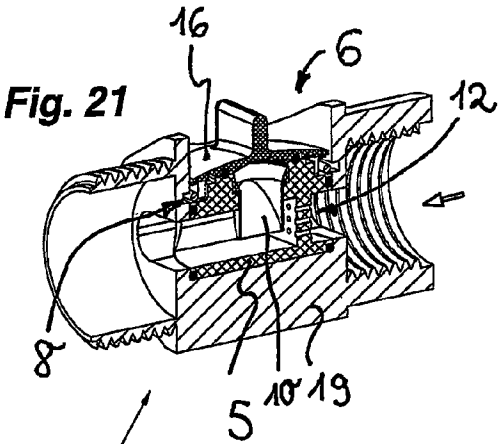
FIG. 21 a longitudinal cross-sectional view of the pipe adapter of the outlet unit shown in FIG. 20, FIG. 22 an exploded view showing individual parts of the aeration device allocated to the outlet unit according to FIGS. 20 and 21, FIG. 23 a view of a sanitary outlet unit with in its cold and warm water feeding lines each including an aeration device located in a pipe adapter being interposed, and the aeration devices can be opened and closed, FIG. 24 a longitudinal cross-sectional view of one of the aeration devices allocated to the outlet unit according to FIG. 23 taken through the pipe adapter, FIG. 25 an exploded view shoeing individual parts of one of the aerations unit allocated to the outlet unit according to FIGS. 23 and 24, FIG. 26 a perspective view of an outlet unit, embodied as a hand or kitchen sprayer, FIG. 27 a perspective view of the outlet unit of FIG. 26 taken from a different angle of view, FIG. 28 a longitudinal cross-sectional view of the outlet unit of FIGS. 26 and 27 in the area of the aeration device integrated in the handle of the shower, FIG. 29 an exploded view showing individual parts of the aeration device allocated to outlet unit according to FIGS. 26 through 28, FIG. 30 a partial cross-sectional view of an aeration device embodied as an inserted casing or integrated cartridge provided with an umbrella valve, FIG. 31 a side view of the aeration device of FIG. 30, FIG. 32 a longitudinal cross-sectional view of the aeration device of FIGS. 30 and 31, FIG. 33 a bottom perspective view of the aeration device of FIGS. 30 through 32, FIG. 34 an exploded view showing individual parts of the aeration device of FIGS. 30 through 33, FIG. 35 a side view of the umbrella or shield valve of the aeration device shown in FIGS. 30 through 34, FIG. 36 a longitudinal cross-sectional view of the umbrella valve of FIG. 35, FIG. 37 a perspective view of the umbrella valve of FIGS. 35 and 36, FIGS. 38-39 the valve body carrying the valve seat of the umbrella valve shown in FIGS. 36 and 37 in a side view (FIG. 38) and in a perspective representation (FIG. 39), FIGS. 40-41 a gasket arranged at the exterior perimeter of the valve body in a side view (FIG. 40) and in a perspective representation (FIG. 41), and FIGS. 42-43 the valve umbrella of the umbrella valve shown in FIGS. 36 through 41 in a side view (FIG. 42) as well as in a perspective top view (FIG. 43).
Figure 20:
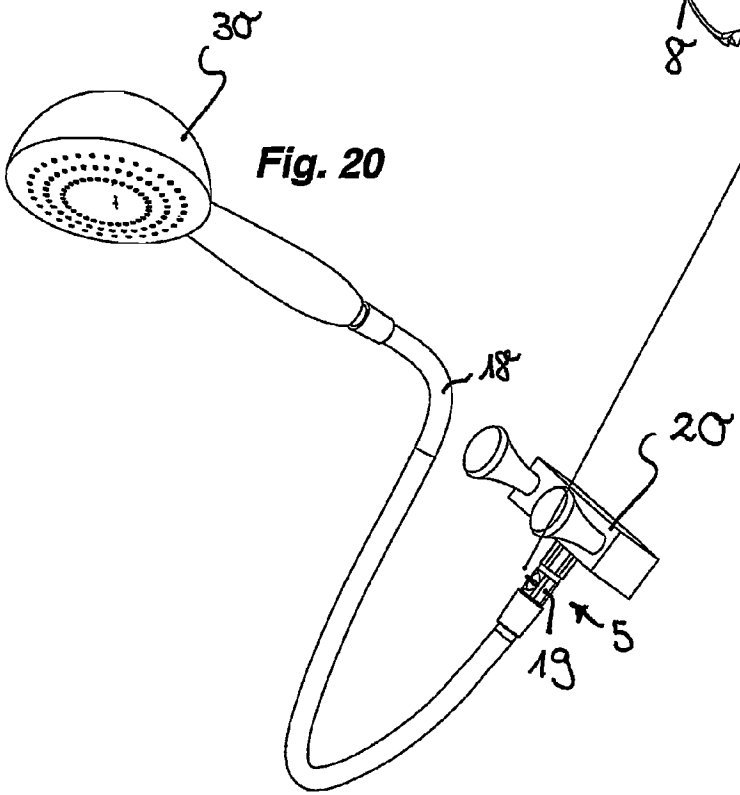

In FIGS. 20 through 22, a sanitary outlet unit 1 is formed, which is embodied as a shower. In the hose 18 leading to the shower head 30 an aeration device 5 is interposed, which is arranged in a pipe adapter 19. As discernible from a comparison of the FIGS. 20 and 21, the pipe adapter 19, having a cross-section in the form of a sheath or pipe-section, has at its end section an interior thread, which can be screwed onto a screw neck stub provided at the fitting outlet 20 of the outlet unit 1. At the opposite end region of the pipe adapter 19 an exterior thread is provided, onto which the hose 18 leading to the shower head 30 can be screwed. The aeration device 5, that can be inserted through a lateral insertion opening 6 into the pipe adapter 19 and here also be secured by a snap ring 8, can be opened and closed via the closing lid 16. The pipe adapter 19 can also be connected in a retrofitting manner to any commercially available hose 18. The pipe adapter 19 with the aeration device 5 located therein allows the user to create an aerated or a non-aerated shower jet. The aeration is affected in a similar fashion as in FIGS. 13 through 17, by blocking the air intake via rotating the sealing closing lid 16.

Figure 25:
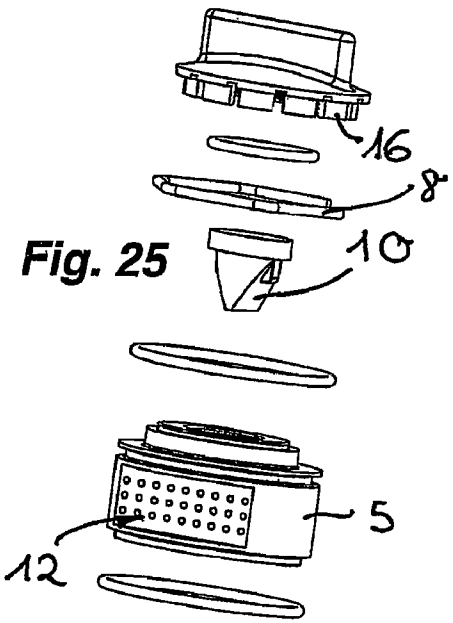
Figure 24:
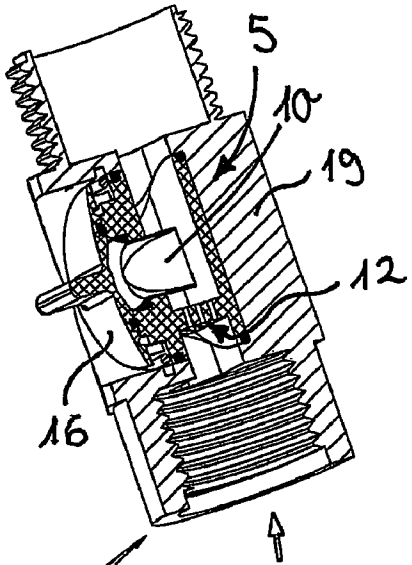
Figure 23:
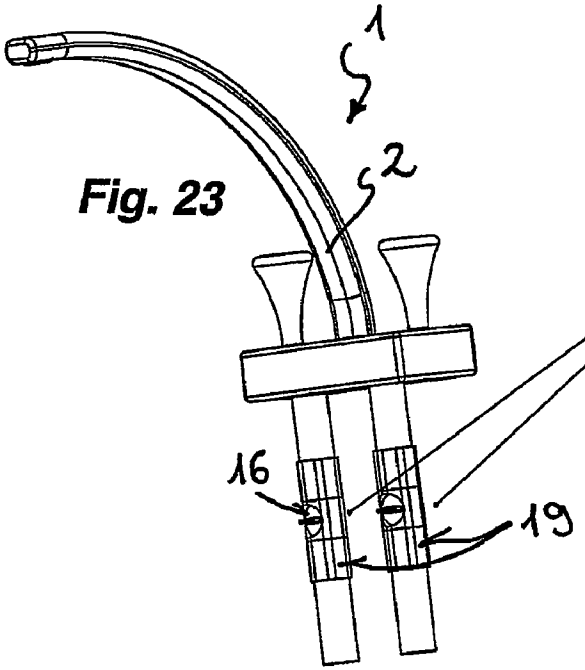
Figures 26, 27, 28, 29:
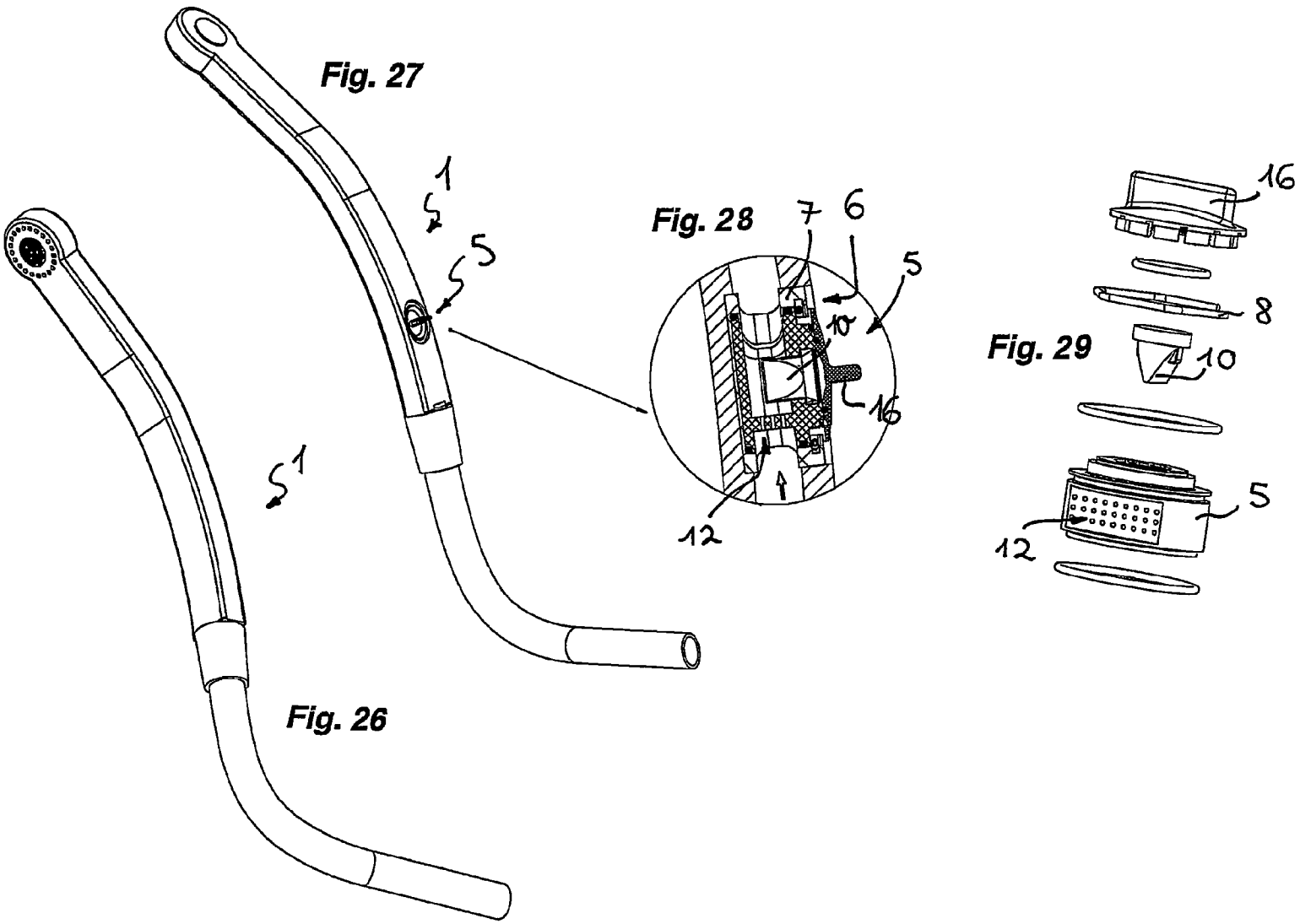
Figure 34:
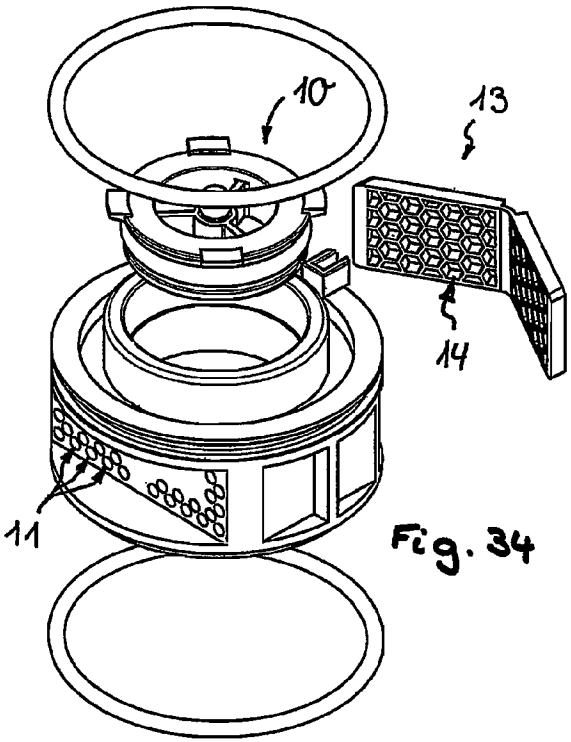
Figure 31:
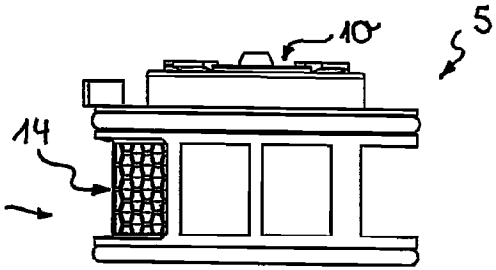
Figure 33:
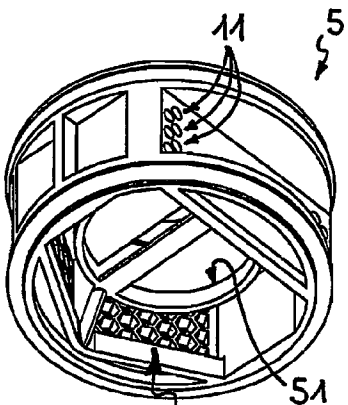
Figure 30:
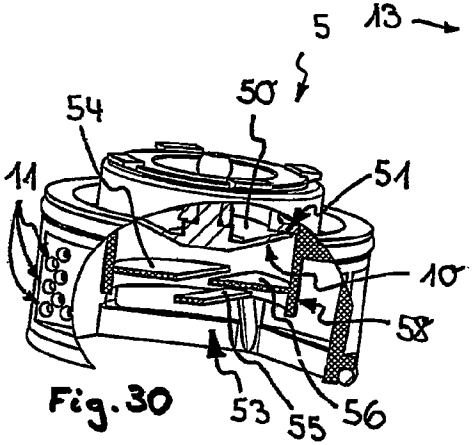
Figure 32:
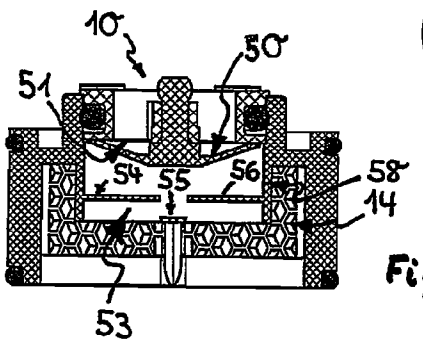

In FIGS. 23 through 25, a connected unit 1 with an outlet armature 2 is shown, with an aeration device 5 located in a pipe adapter 19 being interposed in its warm water and its cold water inlet. Using the pipe adapter 19, which can be retrofitted, as well as the aeration devices 5 located therein makes it possible to discharge optionally an aerated or a non-aerated water jet at the outlet armature. The particular advantage of the outlet unit 1 shown in FIGS. 23 through 25 is the fact that optionally only one of the two feeding pipes is provided with air. By the closing lid 16 provided at the aeration device 5 air, can be mixed optionally only with the warm water or the cold water inlet. This allows recognition by the flow image if it is cold and/or warm water; when the closing lid 16 of the aeration device 5 interposed in the warm water inlet is open and the closing lid 16 of the aeration device 5 allocated to the cold water inlet is closed, a non-aerated and correspondingly crystal clear water jet shows that cold water is flowing, while a strongly aerated water jet indicates hot water, and slightly aerated outflow of water indicates mixed water. The user can therefore determine the approximate temperature state of the water jet using the degree of water/air mixture, namely using the opacity and white coloration of the outflow water due to visible water bubbles.

In FIGS. 26 through 29 an outlet unit 1 is shown, which is here embodied as a hand or kitchen sprayer. In the outlet unit 1 according to FIGS. 26 through 29 embodied as a hand or kitchen sprayer the aeration device 5 is directly integrated in the shower handle. The shower handle of the hand or kitchen sprayer is therefore provided with an insert opening 6, embodied hollow and in the form of a water pipe leading to the interior of the shower handle, into which the aeration device 5 can be inserted from the outside. Normally such hand or kitchen sprayer has the possibility to be switched from spray jet to normal jet and vice versa. By the integration of an aeration device shown here, which for example can be opened or closed via a closing lid 16, it is also possible to design the spray or the normal jet optionally with or without an addition of air, so that the possibility of the jet variation can be doubled by the here provided aeration device 5, which provides the user with an additional use.

In FIGS. 30 to 34, another embodiment of an aeration device 5 is shown, which differs for example from the aeration device shown in FIGS. 3 and 8, among other things, due to an aeration valve embodied as an umbrella valve 10. The aeration device 5 according to FIGS. 30 through 34 is embodied as an inserted casing or integrated cartridge, which in a similar manner to the aeration devices shown above, can be inserted into an upstream arranged sheath-shaped casing or cartridge receptacle, at a distance form the water outlet.

The aeration device 5 of FIGS. 30 through 34, shown as a casing housing, is provided in the upstream direction with several penetrating openings 11, embodied as cross-sectional constrictions, which form an acceleration path 12 for accelerating the water flow to be mixed with air. Here the aeration device 5 is also provided downstream with a water guidance 13, leading the aerated water flow to the interior perimeter of the water pipe and especially the outlet unit, which is embodied as a guidance grid 14 tapering in the flow direction V-shaped or funnel shaped, with its guide walls, surrounding the grid openings, being embodied as water guide walls. The grid openings of this guidance grid 14 are also essentially embodied honeycomb shaped in order to allow the maintenance of a flow cross-section that is as large as possible at the guidance walls surrounding the grid openings. The guidance grid 14 serving as a water guide is provided in the area of the housing outlet of the casing housing and is at the downstream of the cartridge receptacle.

The valve outlet of the aeration valve 10 is arranged in the area between the acceleration path 12 and the housing outlet of the cartridge housing. The valve outlet of the aeration valve opens in a mixing zone, which is arranged in the mouth of the air and water inlet. The water flow accelerated through the acceleration path 12 allows the air entering through the aeration valve 10 to be suctioned, well mixed, and entrained.

The aeration valve 10 of the aeration device 5 shown in FIGS. 30 through 34 is shown in greater detail in FIGS. 34 through 43. As discernible from FIG. 36, the valve umbrella 50 of the aeration valve 10 embodied as an umbrella valve impinges the valve seat 51 with an obtuse angled corner section 62 of the edge of its umbrella perimeter linearly encircling and at a gradual pre-stress via the umbrella perimeter. This pre-stress of the valve umbrella 50, gradually impinging the valve seat 51, is achieved in that the support surface forming the valve seat has different elevations and that the valve seat 51 is allocated in a plane which is arranged at an angle in reference to the plane determined by the edge region of the umbrella perimeter of the unstressed valve umbrella 50. By this linear impingement of the valve seat 51, on the one hand, and/or the gradual pre-stressing of the valve umbrella 50 resting on the valve seat 51, on the other hand, air can be suctioned through the aeration valve 10, without the valve umbrella 50 oscillating and creating undesired trumpet-type noises.

The section 57 of the aeration device 5 guiding the water flow is separated from the one-way aeration valve 10 by a labyrinth 53, which is formed by several, here three, labyrinth walls 54, 55, 56 arranged off-set and at a distance in reference to each other, each of which covers a partial section of the open cross-section arranged between the aeration valve 10 and the section 57. Thereabove, the labyrinth 53 is provided in a cylindrical sheath 58, which extends with its open sheath end, facing away from the aeration valve 10, into the section 57. Using the labyrinth 53 and/or the cylindrical sheath 58 a reverse splashing of the water during the water suction phase is prevented, which otherwise would lead to a calcification at the valve umbrella 50 and could lead to disturbing water residue at the exterior surface of the sanitary outlet armature.

The invention claimed is:

1. A sanitary outlet unit (1) comprising an outlet armature (2) having a water outlet (3), with an aeration device (5) provided for aerating the water jet, the aeration device (5) comprises at least one one-way aeration valve (10) which, when the sanitary outlet is in a closed state, prevents water in the outlet unit downstream of the aeration device from leaking out through the aeration device and is located upstream of the water outlet (3) in a flow direction in at least one of the outlet unit or at least one water pipe leading to the outlet unit, and the aeration device is arranged below the water outlet.

2. A sanitary outlet unit according to claim 1, wherein the outlet unit (2) has a flow regulator (4) in an area of the water outlet (3) and the flow regulator (4) is provided in at least one of the outlet armature (2) or the at least one water pipe leading to the outlet armature (2).

3. A sanitary outlet unit (1) comprising an outlet armature (2) having a water outlet (3), with an aeration device (5) provided for aerating the water jet, the aeration device (5) is located upstream of the water outlet (3) in a flow direction in at least one of the outlet unit or at least one water pipe leading to the outlet unit, and the aeration device is arranged below the water outlet, wherein the aeration device (5) includes at least one duck-bill or membrane valve and/or at least one umbrella valve.

4. An outlet unit according to claim 3, wherein the aeration device (5) is switchable between opened and closed positions.

5. An outlet unit according to claim 3, wherein an aeration opening of the aeration device (5) is provided with an upstream closing lid (16), which in an open position opens an aeration opening and in a closed position closes the aeration opening in a sealing manner.

6. An outlet unit according to claim 1, wherein immediately upstream of a mouth forming a mixing zone of the air and water inlet, an acceleration path (12) is interposed in the water inlet for accelerating a water flow to be mixed with air.

7. An outlet unit according to claim 6, wherein the acceleration path (12) comprises a cross-sectional constriction of a water flow path upstream in reference to the aeration device (5).

8. An outlet unit according to claim 7, wherein the aeration device (5) has a water guidance (13) downstream of the aerated water flow at an interior perimeter of the water flow path or the outlet unit (2).

9. A sanitary outlet unit (1) comprising an outlet armature (2) having a water outlet (3), with an aeration device (5) provided for aerating the water jet, the aeration device (5), comprising a water guidance (13) downstream of the aerated water flow at an interior perimeter of the water flow path or the outlet unit (2), is located upstream of the water outlet (3) in a flow direction in at least one of the outlet unit or at least one water pipe leading to the outlet unit, and the aeration device is arranged below the water outlet, wherein immediately upstream of a mouth forming a mixing zone of the air and water inlet, an acceleration path (12), comprising a cross-sectional constriction of a water flow path upstream in reference to the aeration device (5), is interposed in the water inlet for accelerating a water flow to be mixed with air, wherein the water guidance (13) comprises a guidance grid (14), that is V-shaped or funnel shaped and tapers in a flow direction, with guide walls, surrounding openings of the grid that are embodied as water guide walls.

10. An outlet unit according to claim 9, wherein the grid openings of the guidance grid (14) are generally honeycomb shaped.

11. An outlet unit according to claim 1, wherein the aeration device (5) comprises an insertion casing or an integrated cartridge, which can be inserted into a pipe or fitting section leading to the water outlet (3).

12. A sanitary outlet unit (1) comprising an outlet armature (2) having a water outlet (3), with an aeration device (5) provided for aerating the water jet, the aeration device (5), comprising an insertion casing or an integrated cartridge, which can be inserted into a pipe or fitting section leading to the water outlet (3), is located upstream of the water outlet (3) in a flow direction in at least one of the outlet unit or at least one water pipe leading to the outlet unit, and the aeration device is arranged below the water outlet, wherein a casing housing of the aeration device (5) facing upstream has at least one penetrating opening (11) and the at least one penetrating opening (11) is embodied as the acceleration path (12).

13. An outlet unit according to claim 12, wherein in an area between the acceleration path (12) and the housing outlet of the casing housing, the valve outlet is provided with at least one aeration valve (10).

14. An outlet unit according to claim 1, wherein in a fitting housing, located at a distance upstream in reference to the water outlet (3), an insertion opening (6) is provided leading to an open fitting cross-section, into which the aeration device (5) is insertable.

15. An outlet unit according to claim 14, wherein the insertion opening (6) opens in a sheath-shaped cartridge or casing receptacle (7), which is sized for accepting the aeration device (5) embodied as an insertion casing or integrated cartridge.

16. An outlet unit according to claim 1, wherein the aeration device (5) is arranged in a pipe adapter, which can be interposed in the at least one water pipe leading to an outlet armature (2).

17. An outlet unit according to claim 16, wherein the aeration device (5) is interposed in at least one of a warm water or a cold water pipe.

18. A sanitary outlet unit (1) comprising an outlet armature (2) having a water outlet (3), with an aeration device (5) provided for aerating the water jet, the aeration device (5) is located upstream of the water outlet (3) in a flow direction in at least one of the outlet unit or at least one water pipe leading to the outlet unit, and the aeration device is arranged below the water outlet, wherein the outlet armature (2) comprises a shower head.

19. A sanitary outlet unit (1) comprising an outlet armature (2) having a water outlet (3), with an aeration device (5) provided for aerating the water jet, the aeration device (5) is located upstream of the water outlet (3) in a flow direction in at least one of the outlet unit or at least one water pipe leading to the outlet unit, and the aeration device is arranged below the water outlet, wherein the outlet comprises at least one of a hand or kitchen sprayer.

20. An outlet unit according to claim 1, wherein a valve umbrella (50) of the one-way aeration valve (10), in a closed position, impinges a valve seat (51) linearly at least one of encircling or with a pre-stress via an umbrella perimeter in a gradual or similarly diverging manner.

21. An outlet unit according to claim 20, wherein the valve umbrella (50) of the one-way aeration valve (10) impinges in the closed position the valve seat (51) with an edge region (52) of the umbrella perimeter in a linear fashion.

22. An outlet unit according to claim 20, wherein the valve seat (51) is arranged in a plane arranged at an angle in reference to a plane determined by an edge region of the umbrella perimeter of the unstressed valve umbrella (50).

23. An outlet unit according to claim 1, wherein a labyrinth (53) is arranged in a flow direction downstream in reference to the one-way aeration valve (10) or a backflow preventer, which separates a section (57) of the aeration device (5) guiding the water flow from the one-way aeration valve (10) or from the backflow preventer.

* * * * *